US009493974B2

(12) United States Patent
Ng

(10) Patent No.: US 9,493,974 B2
(45) Date of Patent: Nov. 15, 2016

(54) BLIND HINGE STRUCTURE USED FOR FURNITURE

(71) Applicant: GUANGDONG TAIMING METAL PRODUCTS CO. LTD, Foshan, Guangdong (CN)

(72) Inventor: Tai Wai Ng, Foshan (CN)

(73) Assignee: Guangdong Taming Metal Products Co., Ltd., Foshan (CN)

( * ) Notice: Subject to any disclaimer, the term of this patent is extended or adjusted under 35 U.S.C. 154(b) by 0 days.

(21) Appl. No.: 14/286,819

(22) Filed: May 23, 2014

(65) Prior Publication Data

US 2014/0352111 A1 Dec. 4, 2014

(30) Foreign Application Priority Data

Jun. 4, 2013 (CN) ..... 2013 2 0315512 U

(51) Int. Cl.
*E05F 5/02* (2006.01)
*E05F 5/00* (2006.01)

(52) U.S. Cl.
CPC ..... *E05F 5/006* (2013.01); *E05F 5/02* (2013.01); *E05Y 2201/21* (2013.01); *E05Y 2201/264* (2013.01); *E05Y 2900/20* (2013.01); *Y10T 16/5383* (2015.01)

(58) Field of Classification Search
CPC ..... E05F 5/006; E05F 3/20; E05F 5/00; E05F 3/02; E05F 3/04; E05F 1/08; E05F 1/10; E05F 1/1025; E05F 1/1041; E05F 1/105; E05F 1/1058; E05F 1/1091; E05F 1/1246; E05F 1/1253; E05F 5/02
USPC ..... 16/71, 72, 75, 76, 77, 49, 57, 58, 66
See application file for complete search history.

(56) References Cited

U.S. PATENT DOCUMENTS

| | | | | | |
|---|---|---|---|---|---|
| 1,034,115 | A * | 7/1912 | Johnson | 267/226 |
| 1,055,030 | A * | 3/1913 | Gibbs | 16/66 |
| 3,259,937 | A * | 7/1966 | Kotikov | 16/51 |
| 3,555,591 | A * | 1/1971 | Sogoian | 16/49 |
| 3,711,892 | A * | 1/1973 | Tabor | 16/76 |
| 3,797,817 | A * | 3/1974 | Deisenroth | 267/71 |
| 4,423,535 | A * | 1/1984 | Ojima et al. | 16/85 |
| 5,269,043 | A * | 12/1993 | Yang | 16/68 |
| 5,727,286 | A * | 3/1998 | Shen | 16/49 |
| 8,561,262 | B1 * | 10/2013 | Liang et al. | 16/286 |
| 9,021,656 | B2 * | 5/2015 | Brunnmayr | 16/54 |
| 2003/0200625 | A1 * | 10/2003 | Zimmer | 16/306 |
| 2005/0015927 | A1 * | 1/2005 | Kropf | 16/286 |
| 2009/0271946 | A1 * | 11/2009 | Lam et al. | 16/84 |
| 2010/0170062 | A1 * | 7/2010 | Kim | 16/52 |
| 2013/0097805 | A1 * | 4/2013 | Bland et al. | 16/72 |

FOREIGN PATENT DOCUMENTS

AT WO2012/024711 * 3/2012 ..... E05F 5/10

* cited by examiner

*Primary Examiner* — Emily Morgan
(74) *Attorney, Agent, or Firm* — Maier & Maier, PLLC

(57) ABSTRACT

A damper device for a furniture hinge. Damper device may comprise a movable cup seat provided on the furniture door body and a base provided on the main body of furniture. The base may be connected with one end of the hinge arm. Another end of the hinge arm may be hinged with the movable cup seat. A damping mechanism may be mounted in the cup body of the movable cup seat through a fixing seat. The shape of the fixing seat may match with the cup body. A slide slot may be provided on the fixing seat, permitting the damping mechanism to linearly slide on the slide slot. A working slope for closing hinge may be provided on the damping mechanism and/or hinge arm, so that both the damping mechanism and the hinge arm are connected at least when the hinge is closed.

3 Claims, 7 Drawing Sheets

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

© 2014 Guangdong Taiming Metal Products Co. Ltd.

BLIND HINGE STRUCTURE USED FOR FURNITURE

NOTICE COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims the benefit of priority to Chinese Patent Application No. 201320315512.8, filed Jun. 4, 2013, of which full contents are incorporated herein by reference.

BACKGROUND

1. Field

The present invention relates to a furniture hinge, and in particular relates to a damper device for furniture hinge.

2. Description of the Related Art

On Dec. 21, 2011, Chinese patent (patent number: CN102287103A) disclosed a furniture hinge structure, comprising a hinge cup seat provided on the furniture door body, a base connected with the main body of furniture and its damper, a damper is provided on the base plate of the base, a connecting flank corresponding to the damper is provided on the base plate, the damper is provided on connecting ring, a positioning part is provided on the connecting wing, a sleeve in sliding fit with the damper is provided on the damper, a position fixing part is provided on the sleeve corresponding to the positioning part, or a positioning fixing part is provided on the damper corresponding to the positioning part. Connecting flanks are additionally provided on the base of this structure and are connected with the damper or its sleeve through connecting wing, so that the external force generated when the door is closed can directly act on the base plate and main body of furniture through the damper, and the furniture is evenly stressed and become even durable. Furthermore, the connecting flanks and the base plate on base are fixed through riveting, fastening, welding or integrated, the manufacturing process is effectively simplified and the manufacturing cost can be reduced; However, the connecting flanks of this structure have big volume and consume major material, leading to high manufacturing cost; In addition, the damper is exposed and vulnerable, and the appearance is affected. Therefore, it is necessary to make further improvement.

SUMMARY OF THE INVENTION

It is the technical objective of the present utility model to provide damper device for furniture hinge, which is featured by simple and reasonable structure, low manufacturing cost, simple assembly procedures, sound damping effect, esthetic appearance and good practicability, so as to overcome the deficiencies in the prior art.

A damper device for furniture hinge designed according to this objective comprising a movable cup seat (13) provided on the furniture door body and a base provided on the main body of furniture, the base is connected with one end of the hinge arm (12), another end of the hinge arm (12) is hinged with the movable cup seat (13), characterized in that, a damping mechanism is mounted in the cup body of the movable cup seat (13) through a fixing seat (1), the shape of the fixing seat (1) matches with the cup body, and a slide slot (1.1) is provided on the fixing seat, and the damping mechanism can perform linear sliding on the slide slot (1.1); A working slope for closing hinge is provided on the damping mechanism and/or hinge arm (12), so that the damping mechanism and the hinge arm (12) can be connected at least when the hinge is closed.

The damping mechanism comprises a cylinder body and a piston rod, wherein a working slope for closing hinge is provided at the front end of the cylinder body and is connected with the hinge arm at least when the hinge is closed, an end cover (11) is provided at the rear end of the cylinder body, the piston rod is provided in the cylinder body and in turn passes through an end cover, a pressure spring, a pressure spring seat and an O-ring and is finally connected with a piston head at the front end; a damping ring, a piston ring and a reset spring are provided between the piston head and the cylinder body.

The elastic force of the reset spring is greater than the elastic force of the pressure spring.

The radial section of the piston head is designed as circular, O-shaped, Y-shaped, cross-shape, "米"-shaped or *-shaped structure, a blind hole is provided at its bottom and is in coordinated connection with the piston rod, a limiting boss is provided at the corresponding piston ring, the damping ring (5) is designed as circular ring or rectangle ring shape and is designed to realize clearance sliding on the limiting boss (6.2; A guide conical surface is also mounted on the piston head (6) corresponding to the reset spring; at least one oil flow passage is provided on the piston head (6) and the piston ring (4) to allow the damping oil to flow through.

The outer wall of the piston head is tangent with the inner wall of the cylinder body, at least more than one piston head through holes are provided on the piston head for circulation of damping oil; or the outer wall of piston head matches with the inner wall of cylinder body to form oil passage, and at least more than one piston head through holes are provided on the piston head for circulation of damping oil; or, the outer wall of the piston head is tangent with the inner wall of the cylinder body, more than one notches) are provided on the outer wall of the piston head to match with the inner wall of the cylinder body to form an oil passage, and at least more than one piston head through holes are provided on the piston head for the circulation of damping oil.

The outer wall of the piston ring (4) and the inner wall of the cylinder body realize clearance fit to form an oil passage; or the outer wall of piston ring is tangent with the inner wall of the cylinder body, more than one recesses are provided on the outer wall of the piston ring to match with the inner wall of the cylinder body to form an oil passage; or, the outer wall of piston ring is tangent with the inner wall of the cylinder body, and more than one piston ring through holes are provided on the piston ring for circulation of damping oil.

More than two bosses are evenly distributed in ring form on one side of the piston ring (4) which faces towards the damping ring.

The radial section of O-ring is designed as V or Y-shaped structure, and the outer wall of O-ring realizes interference fit with the inner wall of cylinder body; and its back side leans against the pressure spring seat; the pressure spring is fixedly provided between the end cover and the pressure spring seat.

The rear end of the piston rod extends from the end cover and is in coordinated connection with the fixing base or the movable cup seat.

Through clamping, riveting, welding or bonding, the fixing seat is fixedly mounted in the cup seat of movable cup seat, and a limiting part is provided at the end of its slide slot and is in slide limiting with the damping mechanism.

The damping mechanism is provided in the movable cup seat, the hinge is buffered under the action of damping mechanism when it is closed, so that the door body is slowly closed, and furniture is preferably protected. Furthermore, the damper device of the present invention is featured by simple and reasonable structure, low manufacturing cost, simple assembly procedure, elegant appearance, sound damping effect and good practicability.

DESCRIPTION OF ATTACHED DRAWINGS

Figure 3:
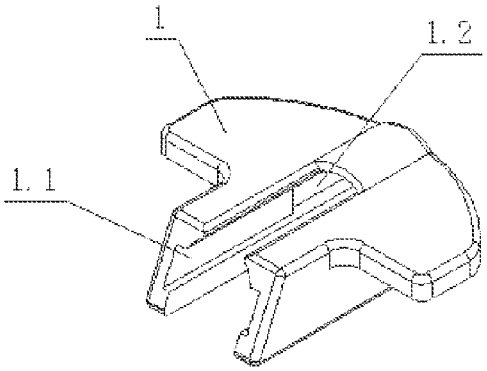
Figure 4:
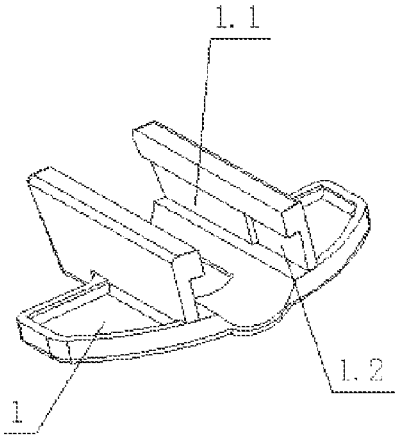

FIG. 3 and FIG. 4 provide the structure diagram of the fixing seat.

Figure 5:
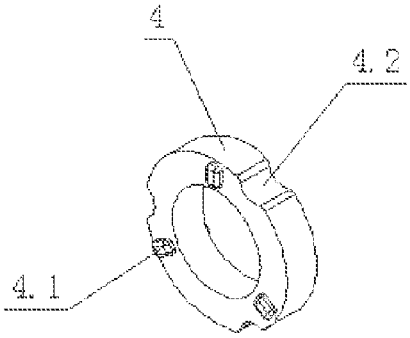
Figure 6:
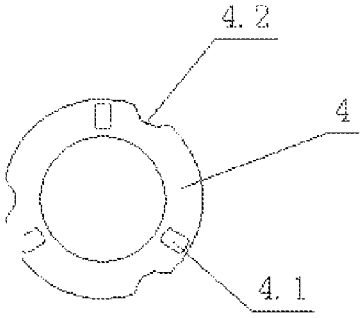

FIG. 5 and FIG. 6 illustrate the structure diagram of the piston ring in the first embodiment.

Figure 7:
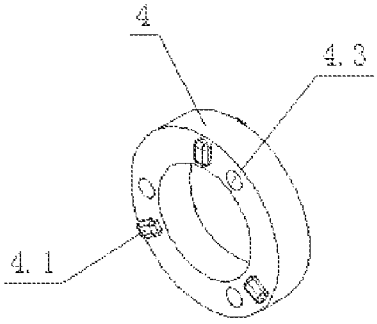
Figure 8:
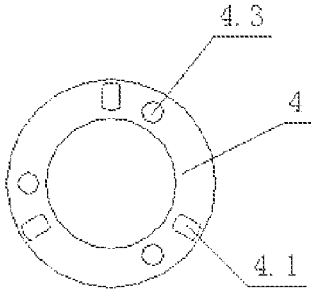

FIG. 7 and FIG. 8 illustrate the structure diagram of the piston ring in the second embodiment.

Figure 9:
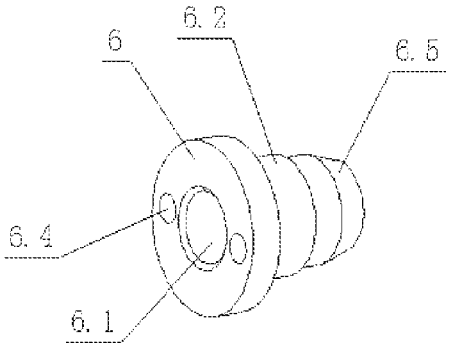
Figure 10:
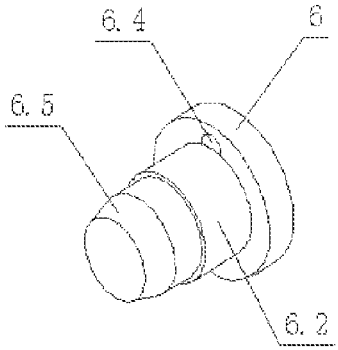

FIG. 9 and FIG. 10 illustrate the structure diagram of the piston head in the first embodiment.

Figure 11:
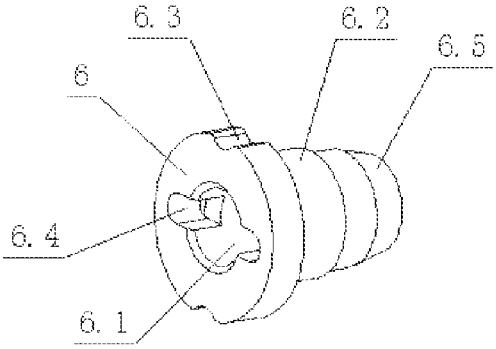
Figure 12:
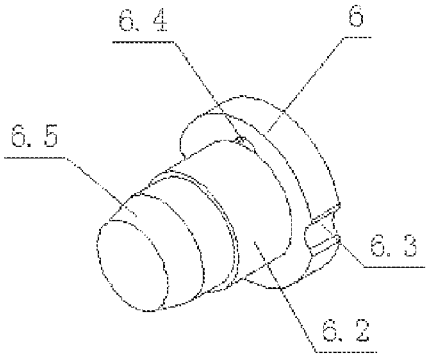

FIG. 11 and FIG. 12 illustrate the structure diagram of the piston head in the second embodiment.

Figure 13:
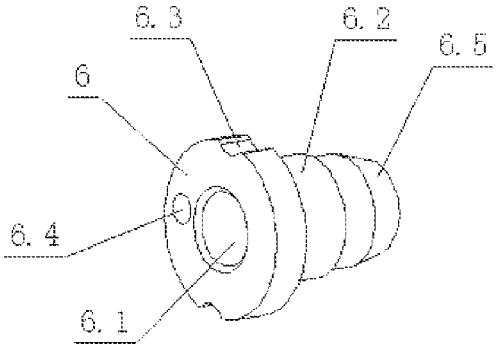
Figure 14:
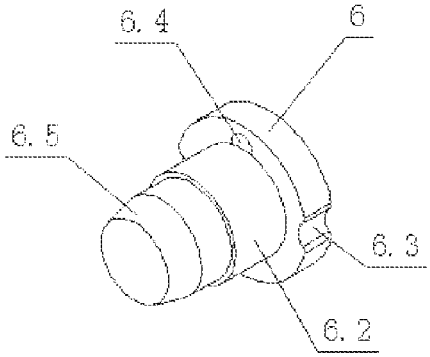

FIG. 13 and FIG. 14 illustrate the structure diagram of the piston head in the third embodiment.

Figure 15:
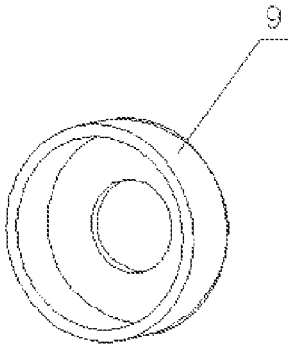
Figure 16:
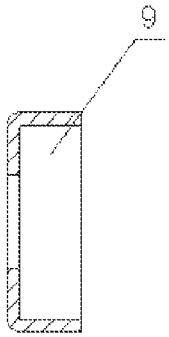

FIG. 15 and FIG. 16 illustrate the structure diagram of the pressure spring seat in the first embodiment.

Figure 17:
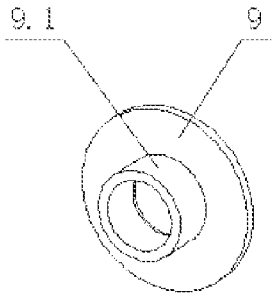
Figure 18:
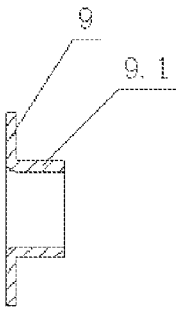

FIG. 17 and FIG. 18 illustrate the structure diagram of the pressure spring seat in the second embodiment.

Figure 19:
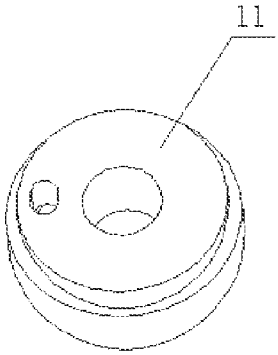
Figure 20:
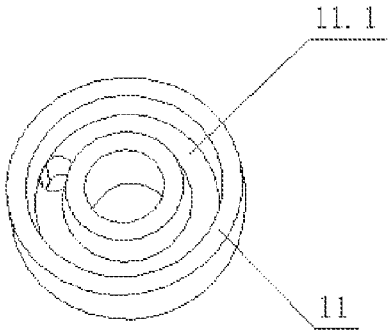

FIG. 19 and FIG. 20 provide the structure diagram of the end over.

Figure 21:
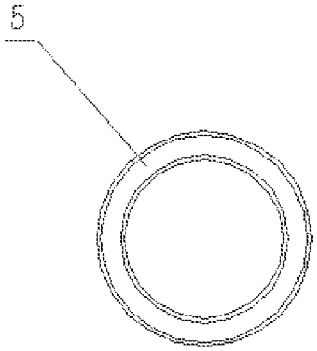
Figure 22:
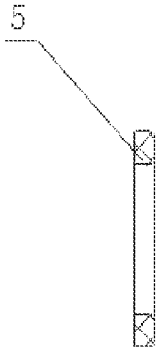
Figure 23:
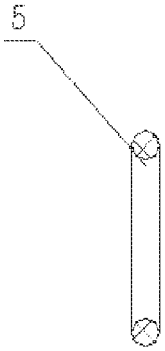

FIGS. 21-23 illustrate the structure diagram of the damping ring.

Figure 24:
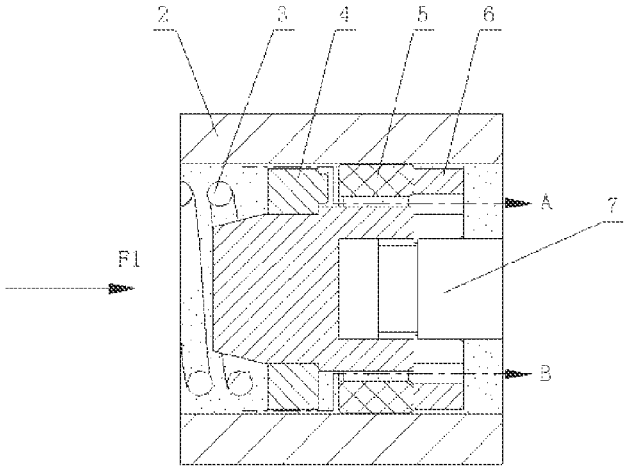

FIG. 24 illustrates the enlarged structure diagram of the working state of damper when the hinge is closed.

Figure 25:
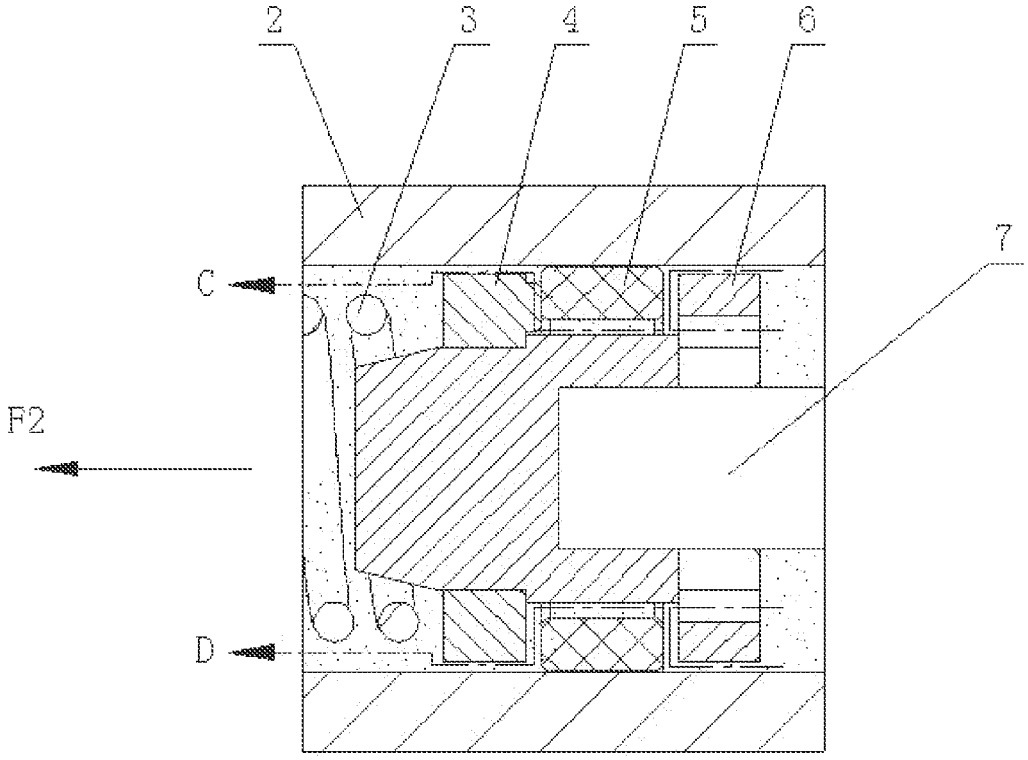

FIG. 25 illustrates the enlarged structure diagram of the working state of damper when the hinge is opened.

Figure 26:
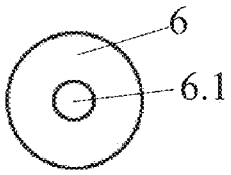

FIG. 26 illustrates a radial section of the piston head having a circular shape.

Figure 27:
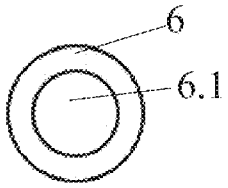

FIG. 27 illustrates a radial section of the piston head having an "O" shape.

Figure 28:
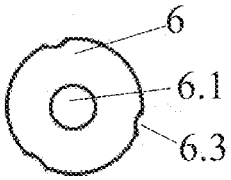

FIG. 28 illustrates a radial section of the piston head having a "Y" shape.

Figure 29:
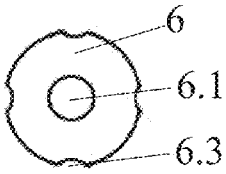

FIG. 29 illustrates a radial section of the piston head having a cross-shape.

Figure 30:
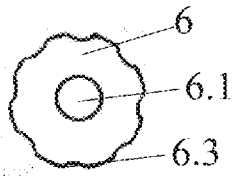

FIG. 30 illustrates a radial section of the piston head having an eight-pointed-star shape.

Figure 31:
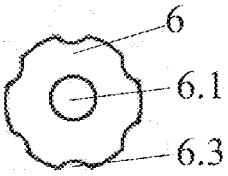

FIG. 31 illustrates a radial section of the piston head having a "*" shape.

Figure 32:
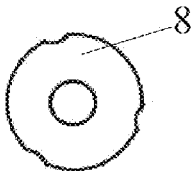

FIG. 32 illustrates an O-ring having a "Y" shape.

Figure 33:
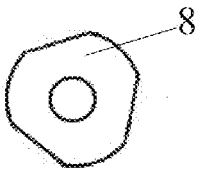

FIG. 33 illustrates an O-ring having a "V" shape.

DETAILED DESCRIPTION OF PREFERRED EMBODIMENTS

Further detailed description of the present invention is provided with reference to specific embodiments in combination with attached drawings.

Figure 1:
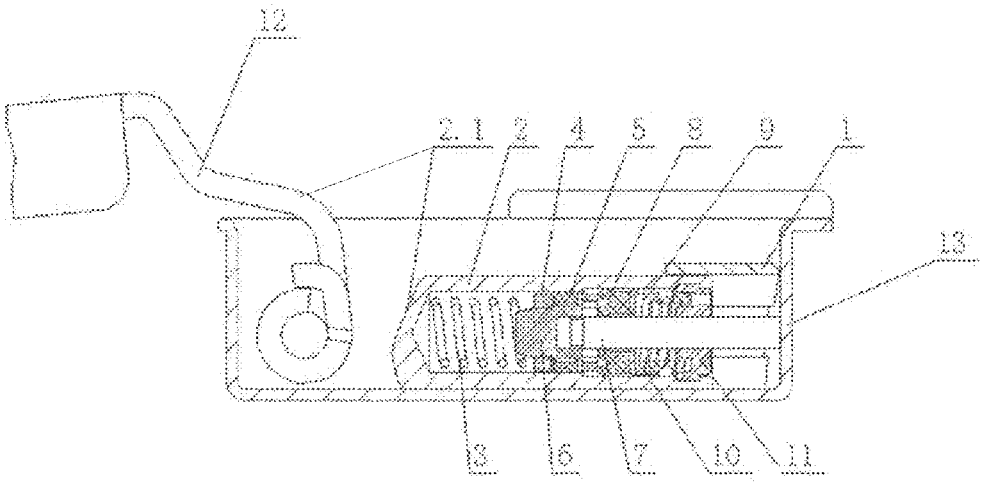
FIG. 1 is the structure diagram of one embodiment of the present invention (section view).
Figure 2:
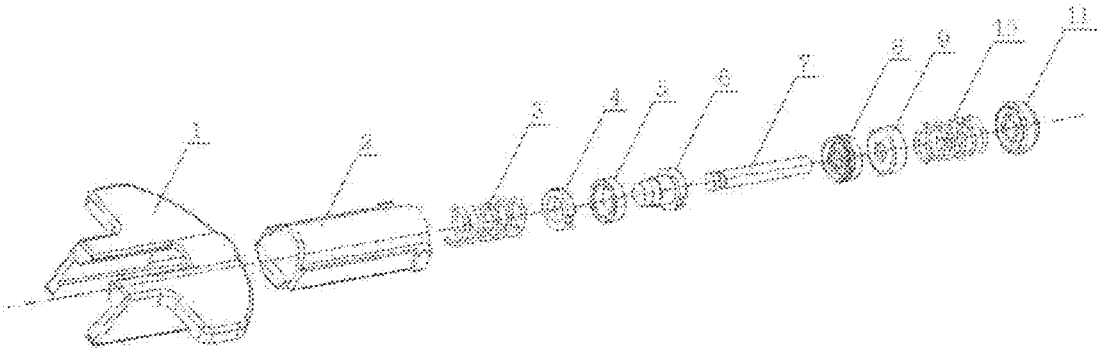
FIG. 2 is the breakdown structure diagram of an embodiment of the present invention.

As shown in FIG. 1 and FIG. 4, A damper device for furniture hinge, comprising a movable cup seat 13 provided on the furniture door body and a base provided on the main body of furniture, the base is connected with one end of the hinge arm 12, another end of the hinge arm 12 is hinged with the movable cup seat 13, characterized in that, a damping mechanism is mounted in the cup body of the movable cup seat 13 through a fixing seat 1, the shape of the fixing seat 1 matches with the cup body; Through clamping, riveting, welding or bonding, the fixing seat is fixedly mounted in the cup seat of the movable cup seat 13; a slide slot is provided on the fixing seat, so that the damping mechanism can make linear sliding on the slide slot 1.1; a limiting part 1.2 is provided at the end of the slide slot 1.1 and is in slide limiting with the damping mechanism. A working slope 2.1 for closing hinge is provided on the damping mechanism and/or hinge arm, so that both the damping mechanism and the hinge arm are connected at least when the hinge is closed.

The damping mechanism comprises a cylinder body 2 and a piston rod 7, wherein a working slope 2.1 for closing hinge is provided at the front end of the cylinder body 2 and is connected with the hinge arm at least when the hinge is closed, an end cover 11 is provided at the rear end of the cylinder body 2, the piston rod 7 is provided in the cylinder body 2 and in turn passes through an end cover, a pressure spring, a pressure spring seat and an O-ring and is finally connected with a piston head at the front end; A damping ring (5), a piston ring (4) and a reset spring (3) are provided between the piston head 6 and the cylinder body 2. The elastic force of the reset spring 3 is greater than the elastic force of the pressure spring 10. The rear end of the piston rod 7 extends from the end cover 11 and is in coordinated connection with the fixing seat 1. The radial section of the piston head 6 is designed as circular, O-shaped, Y-shaped, cross-shape, "米"-shaped or *-shaped structure; In this embodiment, the radial section of the piston head 6 is designed as Y-shaped, a blind hole is provided at its bottom and is in coordinated connection with the piston rod 7, and limiting boss 6.2 is provided on the piston head 6 corresponding to the piston ring 4; As shown in FIGS. 21-23, the damping ring 5 is designed as circular ring or rectangle ring shape and is designed to realize clearance sliding on the limiting boss 6.2; A guide conical surface 6.5 is also mounted on the piston head 6 corresponding to the reset spring 3; the radial section of O-ring (8) is designed as V or Y-shaped structure, and the outer wall of O-ring realizes interference fit with the inner wall of cylinder body 2; and its back side leans against the pressure spring seat.

In said structure, at least one oil passage is provided on the piston ring 4 and the piston head 6 to allow the circulation of damping oil.

Specifically, the outer wall of the piston ring 4 and the inner wall of the cylinder body 2 realize clearance fit to form an oil passage; as shown in FIGS. 5 and 6, the outer wall of piston ring 4 is tangent with the inner wall of the cylinder body 2, more than one recesses 4.2 are provided on the outer wall of the piston ring 4 to match with the inner wall of the cylinder body 2 to form an oil passage; or, as shown in FIGS. 7 and 8, the outer wall of piston ring 4 is tangent with the inner wall of the cylinder body 2, and more than one piston ring through holes 4.3 are provided on the piston ring 4 for circulation of damping oil. More than two bosses 4.1 are evenly distributed in ring form on one side of the piston ring 4 which faces towards the damping ring 5. In this embodiment, three bosses 4.1 are evenly distributed on the piston ring 4.

As shown in FIGS. 9 and 10, the outer wall of the piston head 6 is tangent with the inner wall of the cylinder body 2, at least more than one piston head through holes 6.4 are provided on the piston head 6 for circulation of damping oil; or the outer wall of piston head 6 matches with the inner wall of cylinder body 2 to form oil passage, and at least more than one piston head through holes 6.4 are provided on the piston head 6 for circulation of damping oil; or, as shown in FIGS. 11-14, the outer wall of the piston head 6 is tangent with the inner wall of the cylinder body 6, more than one notches 6.3 are provided on the outer wall of the piston head 6 to match with the inner wall of the cylinder body 2 to form an oil passage, and at least more than one piston head through holes 6.4 are provided on the piston head 6 for the circulation of damping oil, wherein the piston head through holes 6.4 can be communicated with the blind hole 6.1, as shown in FIG. 11.

According to the detailed design requirements, the said recess 4.2, the piston ring through holes 4.3, the notches 6.3 and the piston head through holes 6.4 can be designed through free combination.

The pressure spring 10 is fixedly provided between the end cover 11 and the pressure spring seat 9. Specifically, as shown in FIG. 15, FIG. 16, FIG. 19 and FIG. 20, the pressure spring seat 9 is designed as cover shape, a slot 11.1 is provided on the end cover 11, the pressure spring 10 is fixedly provided between the end cover 11 and the pressure spring eat 9; or, as shown in FIGS. 17-20, a boss 9.1 is provided on the pressure spring seat 9, a slot 11.1 is provided on the end cover 11, the pressure spring 10 is fixedly provided between the slot 11.1 of the end cover 11 and the boss 9.1 of the pressure spring seat 9.

According to detailed design requirements, the fixing modes for the pressure spring 10 can be designed through free combination.

The operating principle: When the hinge is closed, as shown in FIG. 24, the hinge arm 12 applies force of F1 on the cylinder body 2, the damper is compressed rightwards; At the same time, due to the action of damping oil, the pressure P1 in the left chamber of cylinder body 2 is greater than the pressure P2 in the right chamber of cylinder body 2, the damping ring 5 slides closely to the piston head 6, the damping oil respectively flows towards the oil passages on the piston head and the piston ring, namely slowly flow along the direction of arrows A and B, closing speed of hinge is reduced, until the hinge is completely closed.

When the hinge is opened, as shown in FIG. 25, because the elastic force of the reset spring 3 is greater than the elastic force of the pressure spring 10, the reset spring 3 applies force of F2 on the cylinder body 2, the damper extends leftwards; At the same time, due to the action of damping oil, the pressure P1 in the left chamber of cylinder body 2 is less than the pressure P2 in the right chamber of cylinder body 2, the damping ring 5 slides closely to the piston ring 4, the damping oil respectively flows towards the oil passages on the piston head and the piston ring, namely flows along the directions of arrows C and D, until the hinge is completely opened.

As can be observed from FIG. 24 and FIG. 25, the flow rate of damping oil flowing through the oil passage when the hinge is opened is higher than that of damping oil flowing through the oil passage when the hinge is closed; Furthermore, with the opening or closing of hinge, the flow rate of damping oil flowing through the oil passage is controlled with the slide of damping ring 5, so that the opening speed of hinge can be gradually increased while the speed of closing is gradually slowed down. Therefore, the present invention is very practical.

The preferred embodiments of the present invention are described above. All the simple modifications or transformations made by those skilled in the art to these embodiments fall within the claims of the present invention.

It is claimed:

1. A damping mechanism and a furniture hinge, comprising:

a hinge comprising:

a movable cup seat configured to be coupled to a furniture door body, and comprising a hinged connection mounting site, a base configured to be coupled to a main body of furniture, a hinge arm having one end connected to the base and having another end at the hinged connection mounting site to the movable cup seat, the hinge arm has a hinge arm working slope; and a damping mechanism, comprising:

a cylinder body, a damping mechanism working slope provided at a front end of the cylinder body such that the hinge arm and the damping mechanism contact when the hinge is closed, and an end cover, the end cover provided at a rear end of the cylinder body, a pressure spring, a pressure spring seat, the pressure spring is provided between the end cover and the pressure spring seat, an O-ring, a radial cross-section of the O-ring comprises a V or Y-shaped structure, wherein an outer surface of the O-ring realizes an interference fit with an inner surface of the cylinder body, a back side of the O-ring abuts the pressure spring seat, and a piston head comprising a blind hole, a conical surface, and a limiting boss, the piston head disposed linearly within the cylinder body, the piston head has a cross-section;

a piston rod, the piston rod is disposed within the cylinder body such that it passes through the end cover, the pressure spring, the pressure spring seat, and the O ring, the piston rod further being connected to the blind hole of the piston head at a front end of the piston rod, a damping ring has a cross-section that is rectangular or circular and is designed slide on the limiting boss, a piston ring comprising more than two bosses evenly distributed on a side of the piston ring which faces the damping ring, wherein an outer wall of the piston ring and an inner wall of the cylinder body realize clearance fit to form an oil passage, or the outer wall of the piston ring is tangent with the inner wall of the cylinder body and more than one recess is provided on the outer wall of the piston ring to match the inner wall of the cylinder body to form an oil passage, or the outer wall of the piston ring is tangent with the inner wall of the cylinder body and more than one piston ring through hole is provided on the piston ring for circulation of damping oil; and a reset spring disposed within the cylinder body between the piston head and the front end of the cylinder body, an elastic force of the reset spring is greater than an elastic force of the pressure spring, the reset spring corresponds to the conical surface of the piston head; and a fixing seat, shaped to fit within the cup seat, the fixing seat further having a slide slot configured to slidably accept the damping mechanism.

2. The damping mechanism and furniture hinge of claim 1, wherein the rear end of the piston rod extends from the end cover and is in coordinated connection with the fixing seat or movable cup seat.

3. The damper mechanism and furniture hinge disclosed in claim 1, wherein the fixing seat is fixedly provided in the cup seat of the movable cup seat through blocking, riveting, welding or bonding, and a limiting part is provided at the end of its slide slot.

* * * * *